US005272846A

United States Patent [19]

Kelley et al.

[11] Patent Number: 5,272,846

[45] Date of Patent: Dec. 28, 1993

[54] ROOF EDGE ANCHORING DEVICES FOR FOAM ROOFING

[75] Inventors: Tommy D. Kelley; Ralph Kirby, both of Asheville; Kevin D. Rogers, Swannanoa; Mark D. Braine; Donald W. Schultz, both of Asheville; Richard G. Tuttle, Hendersonville; William C. Roberts, Weaverville, all of N.C.

[73] Assignee: W. P. Hickman Company, Asheville, N.C.

[21] Appl. No.: 901,878

[22] Filed: Jun. 22, 1992

Related U.S. Application Data

[63] Continuation-in-part of Ser. No. 532,657, Jun. 4, 1990, abandoned, and Ser. No. 868,948, Apr. 15, 1992, Pat. No. 5,251,411.

[51] Int. Cl.[5] ..... E04D 3/38

[52] U.S. Cl. ..... 52/96; 52/60; 52/62; 52/300

[58] Field of Search ..... 52/58, 60, 62, 94, 96, 52/97, 300, 573

[56] References Cited

U.S. PATENT DOCUMENTS

| | | | |
|---|---|---|---|
| Re. 27,761 | 9/1973 | Attaway . | |
| 3,533,201 | 10/1970 | Tyler | 52/94 X |
| 4,071,987 | 7/1984 | Hickman . | |
| 4,488,384 | 12/1984 | Hickman . | |
| 4,641,476 | 2/1987 | Webb et al. . | |
| 4,662,129 | 5/1987 | Hickman . | |
| 4,964,248 | 10/1990 | Braine et al. . | |

*Primary Examiner*—Carl D. Friedman
*Assistant Examiner*—Kien Nguyen
*Attorney, Agent, or Firm*—Harness, Dickey & Pierce

[57] ABSTRACT

An roof edge assembly for anchoring foam-type roofing materials includes an anchoring flange having a longitudinal channel extending along the edge of the roof, into which a floating retainer member is received and allowed to move to accommodate thermal expansion of the roofing material. At least part of the free-floating retainer member becomes embedded into the foam-type roofing material during its application after the anchoring and retainer members have been installed on the roof. The retainer member is prevented from pulling away during application of the foam. The flange member can be separate or integral with a fascia portion.

29 Claims, 3 Drawing Sheets

FIG. 2.
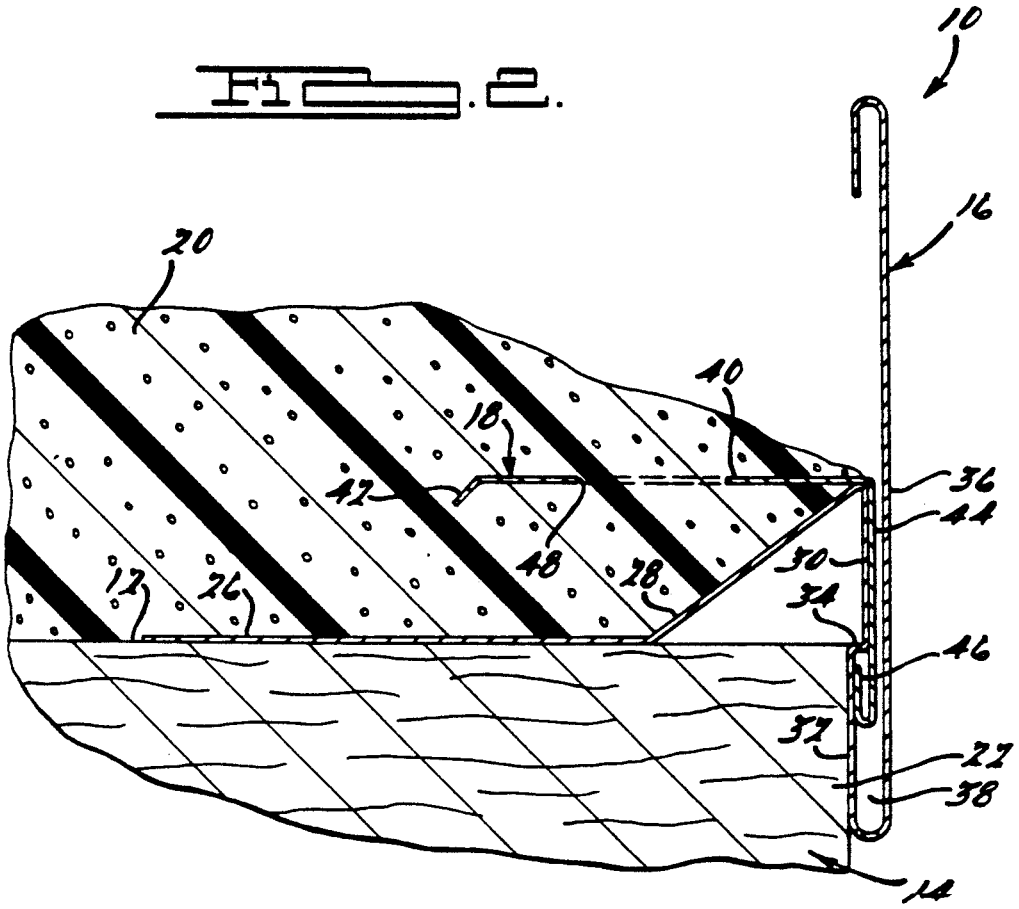
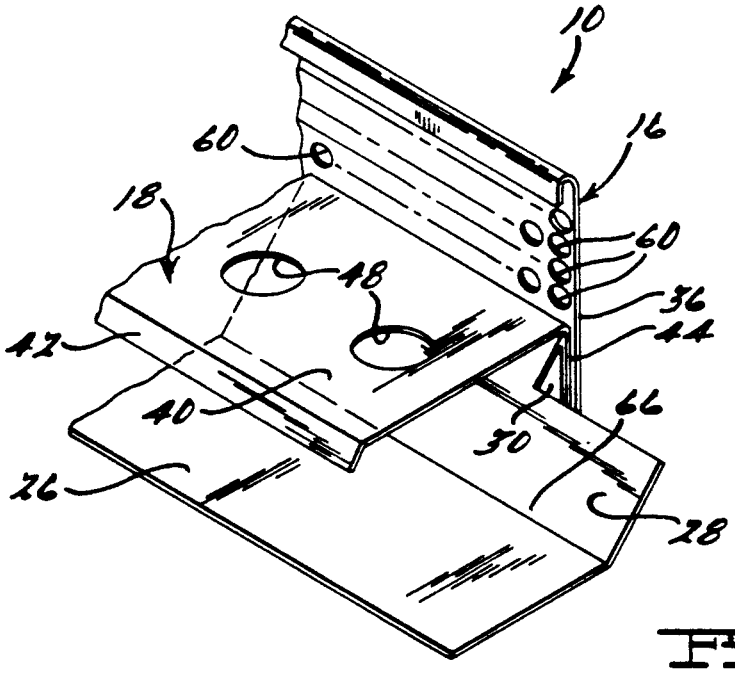
FIG. 3.

ROOF EDGE ANCHORING DEVICES FOR FOAM ROOFING

BACKGROUND AND SUMMARY OF THE INVENTION

This is a continuation-in-part of two copending applications for United States Letters Patents: EDGE SEALING DEVICES FOR MEMBRANE ROOF, Ser. No. 532,657, filed Jun. 4, 1990 now abandoned; and ROOF EDGE ANCHORING DEVICES FOR BUILDING STRUCTURES, Ser. No. 868,948, filed Apr. 15, 1992 now U.S. Pat. No. 5,525,411.

The invention relates generally to building structures and more particularly to roof edge constructions for such building structures, wherein an edge sealing assembly serves to sealing anchor a foam-type roofing material along the edge of a roof of the building structure. The invention can be applied in conventional gravel stop-type roof edge assemblies, drain edges, roof-to-wall reglet assemblies, or other roof terminal structures known to those skilled in the art, all of which are referred to collectively as "roof edges", or "roof edge assemblies", herein.

Various edge sealing constructions, copings, raised roof edge assemblies, gravel stop assemblies, water dams, and the like, have been provided for purposes of anchoring or sealing edges of construction components, anchoring sheet-like roofing or sealing membranes, retaining gravel ballasts or other building materials, controlling water drainage, or for supporting fascia members at the edge of the roof of a building structure, for example. Examples of such previously-provided assemblies are disclosed in U.S. Pat. Nos. 3,719,010; Re. 26,056; 4,071,987; 4,472,931; 4,488,384; 4,549,376; 4,586,301; 4,598,507; 4,617,770; 4,641,476; 4,662,129; 4,759,157; 4,780,999; 4,890,426; 4,909,006; and 4,964,248, as well as, the prior art references cited therein, with all of the above-mentioned patents being owned by the same assignee as the present invention. The disclosures of all of these patents, as well as the above-mentioned copending applications, are thus hereby incorporated herein by reference.

The edge sealing assemblies disclosed in the above-referenced patents represent great strides over previous edge constructions in terms of stability, simplicity, cost-effectiveness, ease of installation, flexibility of application, and effectiveness in anchoring roofing membranes and other roofing materials. However, the desire for even further improvements, as well as the increase in the use of foam roofing materials, such as spray polyurethane foam, for example, has led to the development of the present invention.

Such foam roofing materials are economical, waterproof, seamless, lightweight, and convenient and easy to apply, especially over rough or uneven substrates. These materials do, however, present the disadvantage of being relatively brittle and having a relatively high coefficient of thermal expansion, thus being more susceptible to cracking and leaking at or near the edge of the roof, at least when a continuous metal roof edge is employed. The present invention overcomes these and other problems associated with such foam-type roofing materials by providing a leakproof, snap-in, free-floating anchoring arrangement for such materials that accommodates the thermal expansion and contraction of these materials, thus avoiding their tendencies to crack, break, or otherwise become detached from the roof edge, gravel stop, or cant assembly, which would create undesirable leaks.

In accordance with these objectives, the present invention provides an assembly for forming a roof edge assembly or other roofing material anchoring assembly on a building structure, wherein the preferred assembly includes an anchoring flange or one-piece anchoring flange and fascia that is installed along the edge of the roof prior to the application of the foam roofing material. The preferred anchoring flange includes a longitudinal channel or raceway formed between an anchoring portion and the anchoring fascia portion spaced apart and extending along the edge of the roof, into which a floating retainer member is fitted, preferably in a snapped-in relationship therewith, and allowed to move, both longitudinally and laterally, in order to accommodate the above-discussed thermal expansion.

The free-floating retainer member has openings formed therein, into which the foam flows and becomes embedded during application. Provisions are also made for preventing the retainer member from floating, rising or pulling out during application of the foam.

In this inventive installation, the anchoring flange member can be a separate member having a pair of spaced apart anchoring portions forming the channel, with a separate fascia member attached to the anchoring flange member, or it can be a one-piece member with an integral fascia portion as described above. The fascia or fascia portion, whether separate or integral with the flange member, can include openings or perforations that hold back debris, while allowing water to drain through into a gutter, for example.

Additional objects, advantages, and features of the present invention will become apparent from the following description and appended claims, taken in conjunction with the accompanying drawings.

BRIEF DESCRIPTION OF THE DRAWINGS

FIG. 2 is a cross-sectional view of the exemplary roof edge assembly of FIG. 1, taken generally along line 2—2 of FIG. 1.

FIG. 3 is a partial perspective view of the assembly of FIG. 1, shown apart from its installation on the building structure and illustrating an end construction providing for a lap joint for adjacent, end-to end sections of the assembly.

DETAILED DESCRIPTION OF THE PREFERRED EMBODIMENTS

Figure 1:
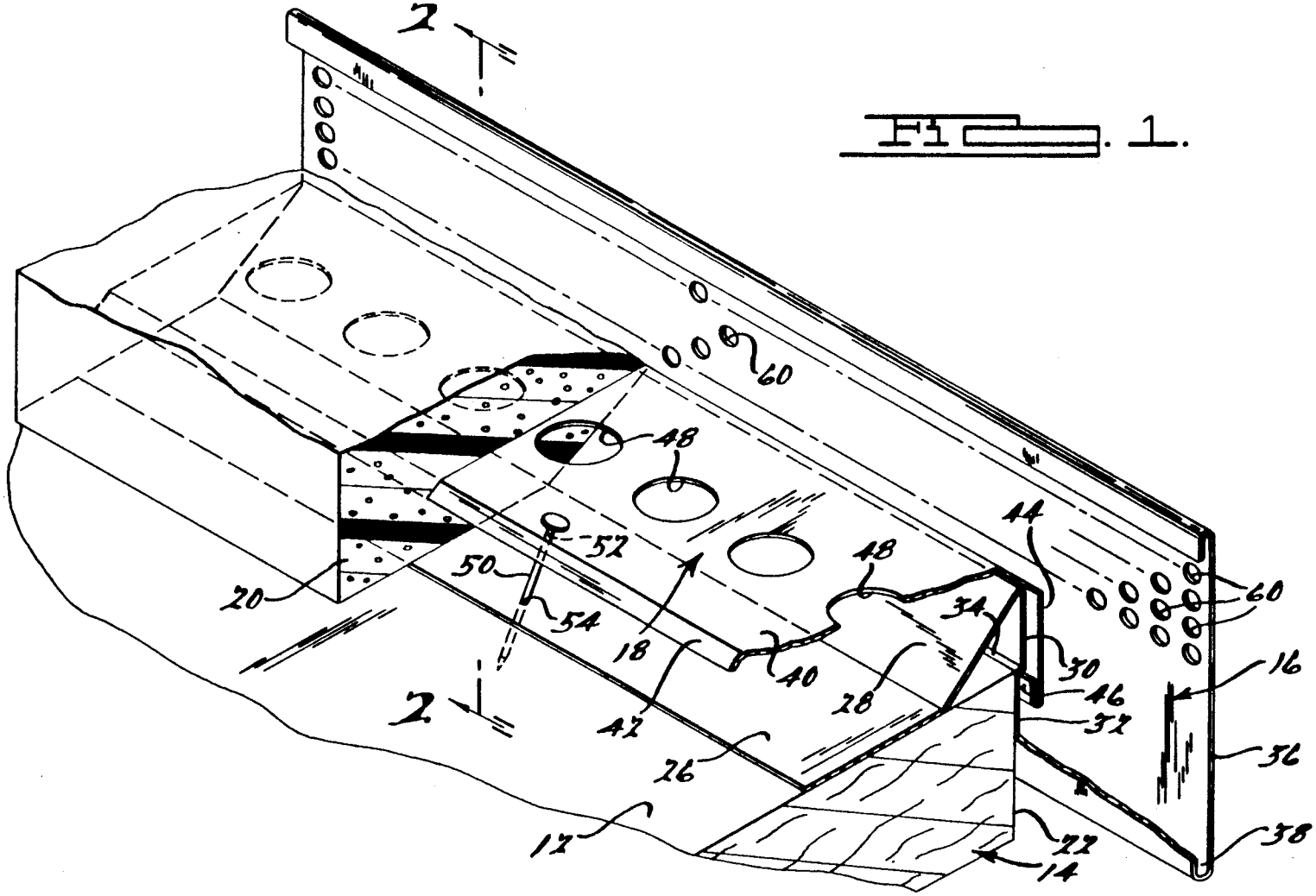
FIG. 1 is a partial perspective view, shown partially in cross-section, of one of the preferred exemplary embodiments of a roof edge assembly according to the invention.

FIGS. 1 through 7 illustrate various exemplary embodiments of an assembly for forming roof edge assemblies on a building structure in accordance with the present invention, provided for purposes of sealing anchoring a foam-type roofing material, while still accommodating its thermal expansion. Although the exemplary embodiments shown in the drawings include one-piece anchoring flange-and-fascia members, it should be noted that the invention is equally applicable in assemblies having separate flange and fascia members and in building construction configurations other than those shown for purpose of illustration in the drawings, as well as in other applications for sealing or anchoring other roofing materials in such building constructions.

In FIGS. 1 through 3, a preferred roof edge assembly 10 for forming a roof edge on a horizontal roof surface 12 of a building structure 14 generally includes a one-piece fascia and anchoring member 16 and a retainer member 18 interconnected with the anchoring member for sealingly anchoring a foam-type roofing material 20 extending along the horizontal roof surface 12, with the assembly 10 overlapping the vertical face 22 of the building structure 14.

The exemplary anchoring member 16 preferably includes an anchoring flange portion 26 extending generally horizontally over the horizontal roof surface 14, an inclined anchoring portion 28, a pair of offset, inner, generally vertical anchoring portions 30 and 32 interconnected by a step or other discontinuity 34 such that the lower inner vertical portion 32 is offset inwardly relative to the upper inner vertical portion 30, and an outer vertical anchoring portion, which is an anchoring fascia portion 36 in this preferred example, spaced outwardly from the vertical anchoring portions 30 and 32 from a channel or raceway 38 therebetween.

The exemplary retainer member 18 preferably includes a generally horizontal retainer portion 40 having an inclined lip 42 thereon, a generally vertical retainer portion 44 with a lower tab or barb 46 spaced inwardly therefrom, and a number of anchoring openings 48 formed in the horizontal retainer portion 40. The retainer member 18 is attached to the anchoring the base roofing material 20, and the anchoring flange 26 is preferably attached to the anchoring member 16 by inserting the vertical retainer portion 44 into the channel 38, with the lower tab or barb 46 being resiliently snapped into the channel 38 and restrained therein by way of its interference with the step or other discontinuity 34.

The vertical dimension of the inner vertical portion 30 on the anchoring member 16 is less than the vertical dimension between the horizontal portion 40 and the upper edge of the lower tab or barb 46 on the retainer member 18, thus providing clearance for free-floating vertical movement of the retainer member 18 relative to the anchoring member 16. Similarly, the horizontal or lateral width of the channel 38 on the other anchoring member 16 is greater than the thickness of the vertical retainer portion 44 of the retainer member 18, but less than the combined thickness of the vertical retainer portion 44, the lower tab or barb 46, and the horizontal space therebetween. By such an arrangement, the retainer member 18 is allowed to move or float generally horizontally relative to the anchoring member 16, while still being interlockingly attached therewith. Such accommodation of both vertical and horizontal movement of the retainer member 18 relative to the anchoring member 16 allows for the thermal expansion of the foam-type roofing material 20, which is secured to the retainer member 18, as is discussed in more detail below.

The above-described roof edge assembly 10 is installed on the building structure 14, with the retainer member 18 snapped into the channel or raceway 38 of the anchoring member 16, prior to application of the foam-type roofing material 20.

In the embodiment shown in FIGS. 1 through 3, a long nail or other fastener 50 is inserted through suitable openings 52 and 54 in the horizontal retainer portion 40 and the anchoring flange 26, respectively to engage the building structure 14 in order to secure the assembly 10 to thereto. The relatively long length of the fastener 50 accommodates the vertical space between the horizontal retainer portion 40 and the anchoring flange 26, as well as holding the retainer member 18 in place and preventing it from floating, rising, or otherwise pulling away from the anchoring member 16 during application of the foam-type roofing material 20. It should be noted that if deemed necessary or desirable in a given installation, the anchoring flange 40 and the lower inner vertical portion 32 can optionally be secured to the horizontal surface 12 and the vertical face 22, respectively, of the building structure 14 by way of suitable adhesives or fasteners 24 (not shown) known to those skilled in the art, although this alternate attachment might not be necessary in all installations.

After installation of the assembly 10, as described above, the foam-type roofing material 20 is applied to the roof in a flowable state by conventional means, including spraying, pouring, or otherwise causing the material to flow into and through the openings 48 in the horizontal retainer portion 40 of the retainer member 18 to form the configuration shown in FIGS. 1 and 2. The roofing material 20 then hardens or cures and is therefore interlockingly secured to the retainer member 18 by way of the engagement with the edge of the openings 48 and with the inclined lip 42, causing the retainer portion 40 to be embedded within the cured roofing material 20. In this configuration, the cured roofing material 20 can thermally expand or contract horizontally and vertically along the inclined portion 28, which slopes upwardly and outwardly from the horizontal anchoring flange 26 of the anchoring member 16, with such movement being accommodated by the free-floating relationship of the vertical retainer portion 44 of the retainer member 18 within the channel 38 of the anchoring member 16.

Preferably, the anchoring flange 26 has a number of perforations or openings 60 formed in the fascia portion 36 in order to allow water to flow therethrough and run off the roof, while still holding back debris. In this regard, it should be noted that the assembly 10 can optionally be installed in conjunction with an integral or separate gutter structure (not shown) for collecting such run-off water.

FIG. 3 illustrates an end of a section of the assembly 10 having a joint tab 66 extending longitudinally from the end of the anchoring flange 26 and at least a portion of the inclined portion 28 for overlapping a longitudinally adjacent anchoring member 16 and preventing leaks therebetween at such joints.

Figures 4, 5, 6, 7:
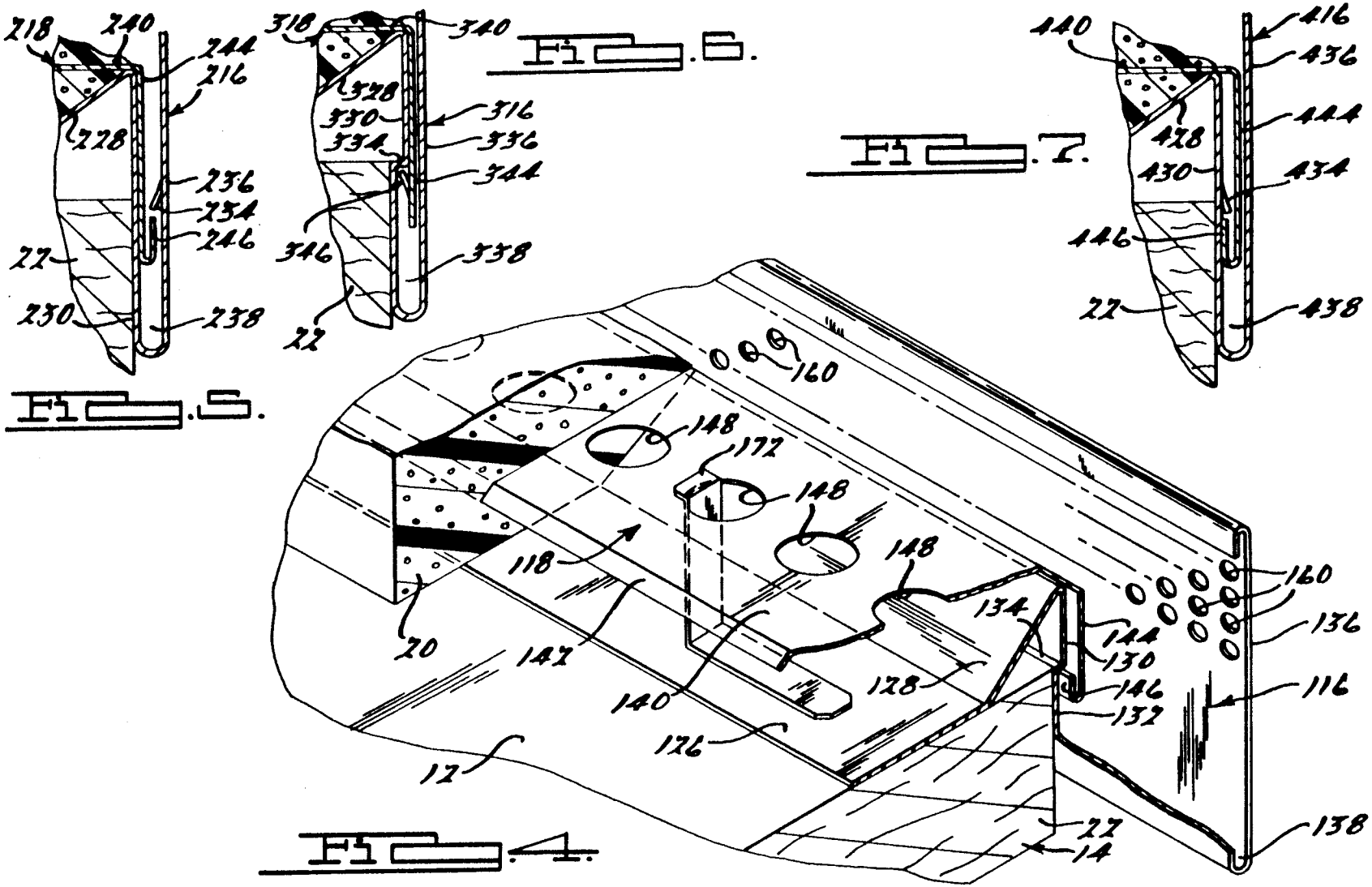
FIG. 4 is a partial perspective view similar to that of FIG. 1, but illustrating an alternate embodiment of the invention having an optional tab member formed on the flange member for preventing the retainer member from floating, rising or pulling away during foam installation.
FIGS. 5, 6, and 7 are partial cross-sectional views, illustrating a number of exemplary alternate embodiments or variations on the present invention.

FIG. 4 illustrates an alternate embodiment of the invention, wherein the roof edge assembly 110 is substantially identical to the roof edge assembly 10 of FIGS. 1 through 3, with certain exceptions noted below. Thus components or elements in FIG. 4 that are identical or substantially similar to corresponding components or elements shown in FIGS. 1 through 3 are indicated by reference numerals to those of FIGS. 1 through 3, but having one-hundred prefixes.

In FIG. 4, the long nails or other fasteners 50 of FIGS. 1 through 3 are replaced by anchoring tabs 170 punched out of, or otherwise secured to, the anchoring flange 126. Such anchoring tabs 170 have hooked ends 172 for extending through the openings 148 and engaging the retainer member 118 in order to prevent the retainer member 118 from floating, rising, or otherwise pulling away from the anchoring member 116. As with the embodiment of FIGS. 1 through 3, the anchoring flange 126 and the vertical portion 132 can optionally be secured to the horizontal roof surface 12 and the vertical face 22, respectively, by suitable fasteners or adhesives (not shown) if deemed necessary or desirable in a given installation. Similarly, the anchoring member 116 can include joint tabs on its section ends, such as those illustrated in FIG. 3.

FIGS. 5, 6, and 7 illustrate various alternate constructions according to the invention, wherein similar or corresponding elements to those of FIGS. 1 through 4 are indicated by corresponding reference numerals, but with the reference numerals in FIGS. 5, 6, and & having two-hundred, three-hundred, and four-hundred prefixes, respectively.

In FIG. 5, the hem or barb portion 46 or 146 is replaced by an outwardly-bent hem or barb portion 246, which is adapted to engage the punched-out barb or discontinuity portion 234 on the fascia portion 236.

In FIG. 6, such barb portion is replaced by the barb portion 346, adapted to engage the stepped portion 334.

Similarly, in FIG. 7, the hem or barb portion 446 is adapted for engagement with the punched-out or barb portion 434 on the inner vertical portion 430.

In this regard, it should be noted that the various alternative constructions shown in FIGS. 5, 6, and 7 can be combined with one another, or with the constructions shown in FIGS. 1 through 4, without departing from the principles of the invention.

The foregoing discussion discloses and describes exemplary embodiments of the present invention. One skilled in the art will readily recognize from such discussion, and from the accompanying drawings and claims, that various changes, modifications, and variations can be made therein without departing from the spirit and scope of the invention as defined in the following claims.

We claim:

1. A roof component assembly for sealingly anchoring a foam-type roofing material on a building roof structure, said assembly comprising:

a fixed anchoring member extending over a portion of said roof structure and fixed thereto, said fixed anchoring member having an open channel formed therein;

a movable retainer member separate from said fixed and anchoring member but having a retainer portion thereof received in said channel formed in said anchoring member, said channel being open a sufficient amount so that said retainer portion is moveable therein relative to said fixed anchoring member; and securing means for securing said foam-type roofing material to said retainer member but not to said fixed anchoring member, said moveable retainer member thus allowing said foam-type roofing material to move therewith relative to said fixed anchoring member.

2. An assembly according to claim 1, wherein said anchoring member further includes a fascia thereon.

3. An assembly according to claim 2, wherein said fascia is integral with said anchoring member.

4. An assembly according to claim 1, wherein the foam-type roofing material is a flowable material that has been allowed to cure and harden in place on the building structure.

5. An assembly according to claim 4, wherein said assembly includes holding means for preventing said retainer member from pulling away from said anchoring member during the application of the foam-type roofing material.

6. An assembly according to claim 5, wherein said holding means includes a fastener extending through said retainer member and said anchoring member and into the building structure.

7. An assembly according to claim 5, wherein said holding means includes a tab protruding from said anchoring member and extending through an opening in said retainer member.

8. A roof component assembly for sealingly anchoring a foam-type roofing material on a building roof structure, said assembly comprising:

an anchoring member extending over a portion of said roof structure and having a channel formed therein;

a retainer member having a portion thereof received in said channel and moveable therein relative to said anchoring member; and securing means for securing said foam-type roofing material to said retainer member, said retainer member allowing said foam-type roofing material to move therewith, said securing means including openings formed in a retainer portion of said retainer member, said retainer portion being embedded in the foam-type roofing material with part of the foam-type roofing material extending through said openings to interlockingly engage said retainer portion.

9. An assembly according to claim 8, wherein said anchoring member includes an anchoring flange portion overlying a portion of said roof structure, an inclined anchoring portion sloping upwardly and outwardly from said anchoring flange portion, at least one generally inner vertical anchoring portion extending along a vertical portion of the building structure, and an outer vertical anchoring portion spaced outwardly from said inner vertical anchoring portion in order to form said channel therebetween.

10. An assembly according to claim 9, wherein said retainer member includes a horizontal retainer portion extending over at least a part of said anchoring member and a vertical retainer portion extending into said channel and moveable therein.

11. An assembly according to claim 10, wherein said vertical retainer portion is moveable both vertically and horizontally in said channel.

12. An assembly according to claim 10, wherein said anchoring member includes a discontinuity thereon, said vertical retainer portion including a barb portion thereon, said barb portion being resilient in order to allow said vertical retainer portion to be snapped into said channel and being engageable with said discontinuity for preventing said vertical retainer portion from being removed from within said channel while still allowing for said movement within said channel.

13. An assembly according to claim 12, wherein said vertical retainer portion is moveable both vertically and horizontally in said channel.

14. An assembly according to claim 13, wherein said fascia is integral with said anchoring member.

15. An assembly according to claim 14, wherein said securing means includes openings formed in a retainer portion of said retainer member, said retainer portion being embedded in the foam-type roofing material with part of the foam-type roofing material extending through said openings to interlockingly engage said retainer portion.

16. An assembly according to claim 12, wherein said discontinuity includes a barb portion.

17. An assembly according to claim 12, wherein said anchoring member further includes a fascia thereon.

18. A roof component assembly for sealingly anchoring a foam-type roofing material on a building roof structure, said assembly comprising:

an anchoring member having an anchoring flange extending over a portion of said roof structure and a pair of generally parallel anchoring portions spaced apart from one another to form an anchoring channel therebetween;

a retainer member having a first retainer portion and a second retainer portion, said first retainer portion having a number of openings therethrough, said second retainer portion being received in said channel and moveable therein relative to said anchoring member; and said first retainer portion being embedded within the foam-type roofing material in order to allow the foam-type roofing material to move therewith, the foam-type roofing material extending through said openings in said first retainer portion.

19. An assembly according to claim 18, wherein said second retainer portion is moveable both vertically and horizontally in said channel.

20. An assembly according to claim 18, wherein said one of said anchoring portions of said anchoring member includes a stepped portion thereon, said second retainer portion including a barb portion thereon, said barb portion being resilient in order to allow said second retainer portion to be snapped into said channel and being interferringly engageable with said stepped portion for preventing said second retainer portion from being removed from within said channel while still allowing said second retainer portion to be moveable within said channel.

21. An assembly according to claim 20, wherein said anchoring member further includes a fascia thereon.

22. An assembly according to claim 21, wherein said fascia includes a number of drainage openings therethrough.

23. An assembly according to claim 22, wherein said fascia is integral with an outermost one of said anchoring portions.

24. An assembly according to claim 21, wherein the foam-type roofing material is a flowable material that has been allowed to cure and harden in place on the building structure.

25. An assembly according to claim 24, wherein said assembly includes holding means for preventing said retainer member from pulling away from said anchoring member during the application of the foam-type roofing material.

26. An assembly according to claim 25, wherein said holding means includes a fastener extending through said retainer member and said anchoring member and into the building structure.

27. An assembly according to claim 25, wherein said holding means includes a tab protruding from said anchoring member and extending through one of said openings in said first retainer portion.

28. An assembly according to claim 27, wherein said tab portion has a hooked outer end thereon.

29. An assembly according to claim 18, wherein said first retainer member includes an inclined portion thereon, said inclined portion also being embedded within the foam-type roofing material.

* * * * *

UNITED STATES PATENT AND TRADEMARK OFFICE

CERTIFICATE OF CORRECTION

PATENT NO. : 5,272,846

DATED : December 28, 1993

INVENTOR(S) : Kelley, et al

It is certified that error appears in the above-identified patent and that said Letters Patent is hereby corrected as shown below:

Abstract line 1, "An" should be --A--.

Column 1, line 17, "sealing" should be --sealingly--.

Column 2, line 66, "sealing" should be --sealingly--.

Column 3, line 6, "purpose" should be --purposes--.

Column 3, line 28, after "32" insert --to--.

Column 3, line 29, "from" should be --form--.

Column 3, line 36, delete "the anchoring".

Column 3, line 50, delete "other".

UNITED STATES PATENT AND TRADEMARK OFFICE

CERTIFICATE OF CORRECTION

PATENT NO. : 5,272,846
DATED : December 28, 1993
INVENTOR(S) : Kelley et al

It is certified that error appears in the above-indentified patent and that said Letters Patent is hereby corrected as shown below:

Column 4, line 2, after "other" insert --long--.

Column 4, line 6, delete "to".

Column 4, line 63, after "numerals" insert --similar --.

Column 5, line 17, "&"should be --7 --.

Signed and Sealed this

Twenty-sixth Day of July, 1994

*Attest:*

*Attesting Officer*

BRUCE LEHMAN

*Commissioner of Patents and Trademarks*